United States Patent [19]

Hölter et al.

[11] Patent Number: 4,802,573

[45] Date of Patent: Feb. 7, 1989

[54] PROCESS FOR WET QUENCHING OF COKE

[75] Inventors: Heinz Hölter; Heinrich Igelbüscher, both of Gladbeck; Heinrich Gresch, Dortmund; Heribert Dewert, Gladbeck, all of Fed. Rep. of Germany

[73] Assignee: Heinz Holter, Gladbeck, Fed. Rep. of Germany

[21] Appl. No.: 12,580

[22] Filed: Feb. 9, 1987

[30] Foreign Application Priority Data

Feb. 8, 1986 [DE] Fed. Rep. of Germany ..... 3603985

[51] Int. Cl.[4] ..... C10B 39/08

[52] U.S. Cl. ..... 201/39; 55/89

[58] Field of Search ..... 201/39; 202/227, 263; 55/89, 228; 210/712

[56] References Cited

U.S. PATENT DOCUMENTS

| | | | |
|---|---|---|---|
| 1,848,818 | 3/1932 | Becker | 201/39 |
| 4,246,072 | 1/1981 | Brommel | 201/39 |
| 4,322,269 | 3/1982 | Wagener et al. | 201/39 |

FOREIGN PATENT DOCUMENTS

| | | | |
|---|---|---|---|
| 2653755 | 6/1977 | Fed. Rep. of Germany | 201/39 |

OTHER PUBLICATIONS

Perry, *Chemical Engineers' Handbook,* Fifth Edition, 1973, pp. 19–44 and 19–45.

*Primary Examiner*—David L. Lacey
*Assistant Examiner*—Joye L. Woodard
*Attorney, Agent, or Firm*—Herbert Dubno

[57] ABSTRACT

Wet quenching of coke with low vapor emissions is provided when the quenching vapors are bunkered before delivery to the atmosphere and subsequently or immediately a condensate is drawn off and cooled further. The bunkered vapors are intermittently mixed with air to prevent the development of explosive carbon monoxide concentrations. The condensate obtained is again distributed, cooled and subsequently recycled for further condensation. The apparatus for performing this process includes a quenching tower connected with a condensor separator and having a buffer space for the quenching vapors. The buffer space has a closable fresh air valve and the condensor separator has a condensor return with an intermediately connected water purifier and the condensor separator and buffer space are connected with each other. A twin cooling system can be connected with a by-pass for feed back which receives fluid from the water purifier.

3 Claims, 1 Drawing Sheet

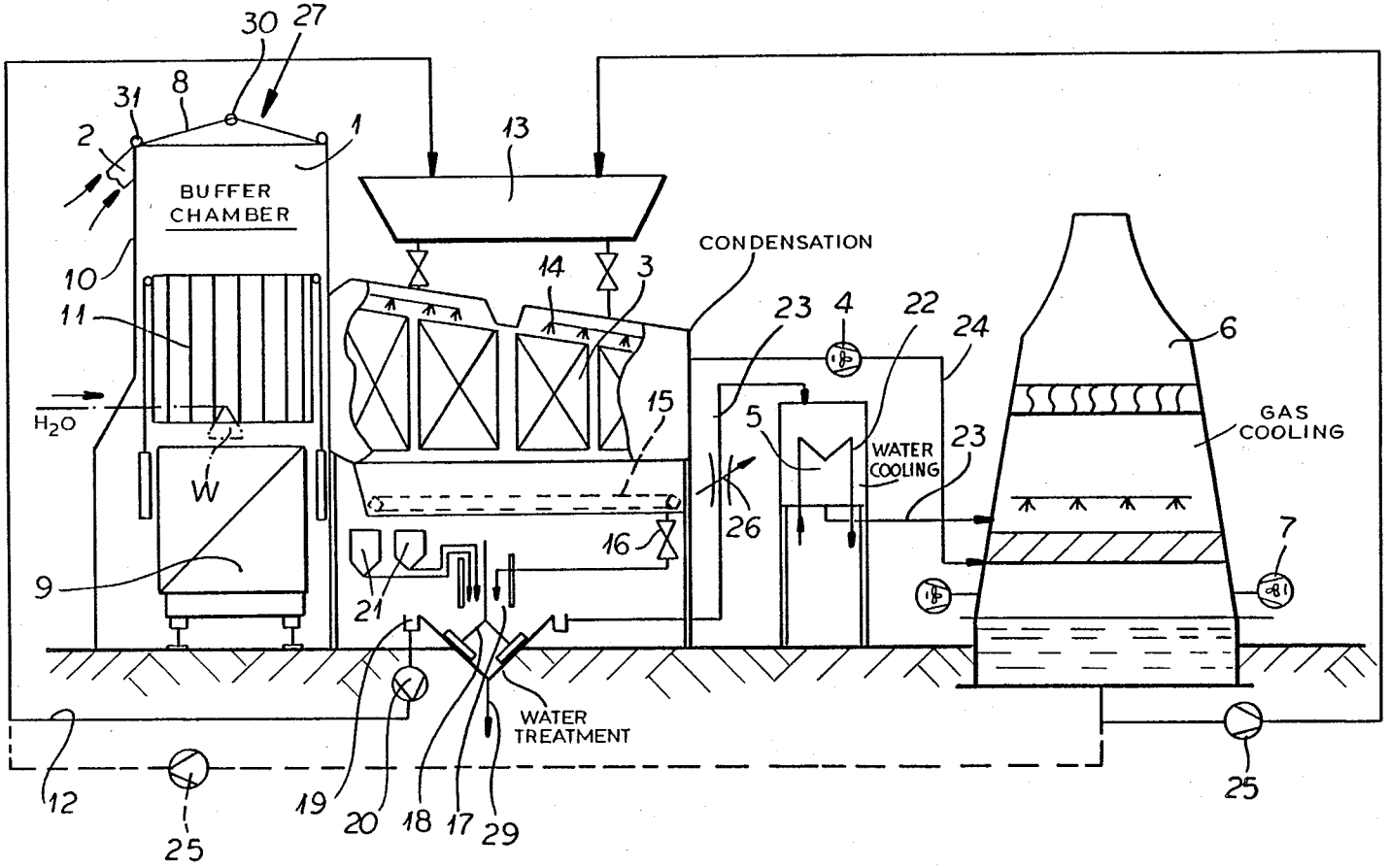
GAS COOLING
WATER COOLING
CONDENSATION
WATER TREATMENT
BUFFER CHAMBER
$H_2O$
1
2
3
4
5
6
7
8
9
10
11
12
13
14
15
16
17
18
19
20
21
22
23
24
25
26
27
29
30
31

PROCESS FOR WET QUENCHING OF COKE

FIELD OF THE INVENTION

Our present invention relates to a process and apparatus for quenching coke with reduced smoke and vapor emissions.

BACKGROUND OF THE INVENTION

In the quenching of coke, the glowing coke can be sprayed with quenching water while the quenching vapor and smoke thus produced are carried away into the atmosphere. In the processing unit for performing this process a quenching tower receives a quenching carriage with the coke.

Over the last decade the glowing coke of a coke plant has been fed by a quenching carriage to a quenching tower in which large quantities of water were sprayed on the glowing coke. Even today most coke plants use this quenching process. The quenching tower is open at its top so that the quenching smoke and vapor arising in the quenching process is delivered directly to the atmosphere.

By the use of suitable baffles in the quenching tower efforts have been made to retain much of the quenching water and the particles entrained therewith to limit environmental pollution.

A coke dry cooling is also known in which an indirect cooling of the glowing coke is effected by heat transfer. The dry cooling of coke and also the so-called wet cooling occur in a closed system.

The plant engineering for carrying out the dry cooling or a cooling in a closed system requires considerable expense (between 150 and 250 million West German marks for the typical coke plant). Also the maintenance of this kind of plant is very expensive, especially since usually the released heat can not be completely utilized because the capacity for abstracting heat energy is simply lacking.

OBJECTS OF THE INVENTION

It is an object of our invention to provide an improved process and apparatus for quenching of coke which at low cost can minimize environmental pollution.

It is also another object of our invention to provide an improved process and apparatus for quenching of coke which has low vapor emissions but also requires a minimal investment and maintenance expense.

It is another object of our invention to provide an improved open but nearly closed system process and apparatus for quenching of coke with low vapor emissions.

SUMMARY OF THE INVENTION

These objects and others which will become more readily apparent hereinafter are attained in accordance with our invention in a process for the quenching of coke with low vapor emissions in which the glowing coke is sprayed with water and thereby quenched while the quenching smoke and vapor arising is delivered ultimately to the atmosphere. These objects are also attained according to our invention in an apparatus for performing this process including a quenching tower which receives a quenching carriage carrying the coke.

According to our invention the quenching smoke and vapor is bunkered i.e. stored in an intermediate storage chamber, before delivery to the atmosphere and after storage or immediately a condensate formed from the smoke/vapor and is drawn away or cooled further. The condensate so obtained is treated, further cooled and subsequently recycled for further condensation. The conventional quenching tower and/or the complete quenching unit is used to a greater extent than heretofore in that the quenching tower is provided with a suitable buffer space to perform continuous condensation. Thus an approximately constant gas volume is continuously removed for processing by the condensation and then further treatment and/or released to the atmosphere. Not only the condensate but also a considerable portion of the coke particles also travelling with it can be collected so that they can be removed without contaminating the environment.

According to a further feature of our invention the intermediately bunkered quenching smoke, vapors or gases are mixed at a location where CO can accumulate intermittently with fresh air to eliminate the danger of peak CO concentrations. By admission of fresh air mixtures into the buffer space and in the vicinity of the condensation, the process avoids exceeding the explosive limit concentrations of CO.

According to another feature of our invention the treated condensate undergoes a two-step cooling in which in one step heat is indirectly removed. By the two-step cooling it is possible to remove only as much usable heat in the one step with indirect cooling as is necessary and suitable for the system. Depending upon the heat removed according to the season the entire cooling energy can be applied to an indirect cooling so that essentially no vapor or smoke emissions occur in this period.

For performing our process the plant has a quenching tower into which a quenching carriage can be introduced.

A condensor separator and a buffer space for the quenching vapor are associated with this quenching tower in our apparatus. The buffer space has a closable fresh air inlet and the condensor separator has a water treatment unit or treatment unit connected thereto with a condensate return for water feedback for further spraying into the condensing unit.

Advantageously the condensor separator and the buffer space are connected with each other. The plant is illustrated with a nearly completely closed system.

The water required for quenching the coke is circulated, i.e. fed to the glowing coke and/or the spray condenser, then recovered in the condenser separator, purified or treated and again returned for spraying to circulate again. As required additional heat is withdrawn from this water and of course the heat withdrawn is as much as the receiver can use.

To provide enough water for the quenching process the water treatment unit has a container with a plurality of rabble or stirrer-scraper members and a water overflow. The condensate return is advantageously connected to the water overflow of the water treatment unit. The circulating water runs through the container with the rabble members, has contaminants removed therefrom and runs purified into the water overflow from where it either immediately is fed back to a water collection vessel (and then to the condensor separator of course) or can be further cooled by a cooler.

After indirect cooling and having traversed a cooling tower this water similarly then is fed back to the water collection vessel so that a similar uniform supply of cooling water is available for the condenser separator.

For cooling the water passed through a by-pass of the recycling path, a twin cooling system with a cooler formed as a heat exchanger and a connected cooling tower is provided.

The water is first indirectly cooled in the heat exchanger and can be cooled further as need arises in this tower before it arrives back in the water collection vessel. Thus it is possible to connect a throttle in the by-pass pipe and by an appropriate device, for example a pump, to send more or less water to be cooled through the cooler formed as a heat exchanger. This cooler is suitably formed as a water-cooled heat exchanger because in this way the abstracted heat can be used directly or further conducted away.

The vapors produced during the quenching process are transported by upward flow to the peak of the quenching tower at which the buffer space is located.

Furthermore the plates covering the top of the quenching tower, i.e. the roof of the tower, can advantageously be pivotally mounted so that the tower can be opened to discharge when necessary, uncondensed and unpurified portions of the quenching smoke and vapors directly into the atmosphere. With closed plates these quenching vapors are fed into the buffer space and then continuously drawn into the condensor separator.

Thus with our invention the allowed smoke/vapor emissions to the atmosphere are kept to a minimum with considerably reduced investment and operating costs.

BRIEF DESCRIPTION OF THE DRAWING

The above and other objects, features and advantages of our invention will become more readily apparent from the following description, reference being made to the sole FIGURE of the accompanying drawing which is a diagrammatic vertical cross sectional view of a processing unit or apparatus for performing the coke quenching process with low smoke/vapor emissions.

SPECIFIC DESCRIPTION

At the left of the FIGURE a quenching tower 10 is illustrated into which the quenching carriage 9 can be pushed.

In this quenching tower 10, which is closed on both sides by a door 11, the quenching smoke/vapor formed by a spray of water represented at W is not directly released into the atmosphere but instead is treated further.

The top of the quenching tower 10 has a buffer space 1 which has a fresh air inlet 2 through which fresh air can be drawn into the buffer space 1 to eliminate an undesirable peaks in CO concentration. The fresh air feed is controllable. Dangerous (explosive) mixtures can not therefore collect in the buffer space 1. The quenching smoke/vapors are either drawn away directly from the quenching tower 10 or indirectly from the buffer space 1 continuously by downstream suction of the blower 4 connected to the condensor separator 3. In the condensor separator 3 the quenching smoke/vapors are scrubbed by the sprays 14 of cooling water so that most of the smoke/vapor can be obtained as a condensate. This water is fed to the water collector vessel 13 by the condensate return 12. A transport belt 15 positioned under the condensor separator 3 ensures that the solid material which is collected there is carried away. An appropriate control is possible with the valve 16.

The condensate leaving the condensor separator 3 is neutralized in the water treatment unit 17 and solid materials are removed so that the condensate can then be fed in the condensate return 12 to the water collector vessel 13. The solid material is pushed to the center by the rabble members 18 and then removed through the outlet 29 to a suitable container, e.g. a thickener. The treatment unit 17 is a cylindrical vessel in which stabilizing zones are provided in which the water is released from the fine grain solid material by addition of a flocculant. The thickners for this purpose are contained in thickener tanks 21. The purified condensate is pumped back to the fluid collector vessel 13 by the pump 20 through condensate return 12.

A by-pass pipe 23 is connected to a water overflow 19 and runs through the indirect cooler 5 where heat is withdrawn from the condensate by water circulated therethrough. The treated condensate water is then cooled still further in a cooling tower 6. Blowers 7 are provided for the cooling tower 6 which remove residual heat from the cooling water. The water and/or condensate flow is partially controlled by the throttle 26.

The gas leaving the condensor separator 3 through the pipe 24 is fed through the blower 4 and into the cooling tower 6. It is freshly sprayed to provide additional cooling. It is delivered by the cooling tower 6 into the atmosphere with a minimum of smoke generation.

The pump 25 is used to feed the cleaned and cooled water back again into the water collection vessel 13. The plate or plates 8 are pivotally mounted on the peak 27 of the quenching tower 10 for opening the top of the quenching tower 10 as needed so that the quenched gases can reach the atmosphere. For this purpose either a central pivot 30 can be provided or a pivot 31 on both sides of the peak 27 can be provided so that a pivoting of the plates 8 without difficulty is possible as shown. In the illustration suitable lifting and/or pulling devices for controlling the plates 8 have been omitted for the sake of clarity and simplicity.

We claim:

1. In a process for quenching coke with low smoke/vapor emissions in which glowing coke is sprayed with water and thereby quenched while a quenching smoke/vapor is produced wherein the improvement comprises bunkering said quenching smoke/vapor in a storage chamber before delivery to said atmosphere, intermittently mixing said bunkered smoke/vapor with fresh air to prevent an explosive carbon monoxide concentration from developing in the storage chamber in which said quenching smoke/vapor is bunkered, withdrawing said bunkered smoke/vapor from the storage chamber and spraying the withdrawn smoke/vapor with water to form a condensate and a gas phase, separating the gas phase from the condensate and further cooling the separated gas phase, and wherein the condensate is further cooled and recycled for spraying the withdrawn smoke/vapor.

2. The improvement according to claim 1 wherein the further cooling of said condensate occurs by a two step cooling, and in one of the steps of said two step cooling, heat is removed from said condensate indirectly.

3. A method of quenching coke, comprising the steps of:

(a) introducing a wagon of glowing coke into a quenching tower provided with an intermediate storage chamber at an upper portion thereof;

(b) spraying the glowing coke in said wagon with water which generates a smoke/vapor containing carbon monoxide in said tower, and storing at least some of the smoke/vapor thus generated in said storage chamber;

(c) intermittently mixing air with the smoke/vapor stored in said chamber to prevent the development of explosive concentrations of carbon monoxide in the smoke/vapor;

(d) continuously withdrawing smoke/vapor from said tower as it is generated or from said storage chamber and spraying the withdrawn smoke/vapor with water to form a gas phase and a solids-entrained condensate;

(e) separating solids from said solids entrance condensate to recover a separated condensate;

(f) treating said separated condensate with a flocculating agent to flocculate residual fine-grained solids entrained therein;

(g) decanting the treated condensate from said flocculated solids and recycling part of the decanted condensate directly to step (d) as water with which the withdrawn smoke/vapor is sprayed;

(h) subjecting another part of the decanted condensate to indirect heat exchange with heat exchange water to further cool said another part of the decanted condensate by abstracting useful heat therefrom;

(i) spraying the decanted condensate from which useful heat has been abstracted in step (h) into a cooling tower, and forcing the gas phase formed in step (d) through said cooling tower and into the atmosphere along with vapor generated from the decanted condensate sprayed into said cooling tower with low smoke emission to the environment; and (j) collecting condensate at a base of said cooling tower and recycling the collected condensate to step (d) as water with which the withdrawn smoke/vapor is sprayed.

* * * * *